US009964370B2

(12) United States Patent
Orne, III et al.

(10) Patent No.: US 9,964,370 B2
(45) **Date of Patent: *May 8, 2018**

(54) AMBIDEXTROUSLY OPERABLE FIREARM RECEIVER ASSEMBLY

(71) Applicant: American Defense Manufacturing, LLC, New Berlin, WI (US)

(72) Inventors: William Orne, III, New Berlin, WI (US); John Gross, Mukwonago, WI (US)

(73) Assignee: American Defense Manufacturing, LLC, New Berlin, WI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/364,486

(22) Filed: Nov. 30, 2016

(65) Prior Publication Data

US 2017/0082385 A1 Mar. 23, 2017

Related U.S. Application Data

(63) Continuation of application No. 14/669,260, filed on Mar. 26, 2015, now Pat. No. 9,541,339.

(51) Int. Cl.

| | |
|---|---|
| ***F41A 3/66*** | (2006.01) |
| ***F41A 3/72*** | (2006.01) |
| ***F41A 17/38*** | (2006.01) |
| ***F41A 17/42*** | (2006.01) |
| ***F41A 35/06*** | (2006.01) |

(52) U.S. Cl.

CPC ..... *F41A 3/66* (2013.01); *F41A 3/72* (2013.01); *F41A 17/38* (2013.01); *F41A 17/42* (2013.01); *F41A 35/06* (2013.01)

(58) Field of Classification Search

CPC .... F41A 3/66; F41A 3/68; F41A 17/38; F41A 17/34; F41A 17/42; F41A 3/72

USPC ..... 42/16

See application file for complete search history.

(56) References Cited

U.S. PATENT DOCUMENTS

| | | | |
|---|---|---|---|
| 3,225,653 | A | 12/1965 | Parkard |
| 4,414,769 | A | 11/1983 | Mueschke |
| 4,615,134 | A | 10/1986 | Beretta |
| 4,638,581 | A | 1/1987 | Moore |
| 4,713,902 | A | 12/1987 | Wigton |
| 4,726,136 | A | 2/1988 | Dornaus |
| 4,759,144 | A | 7/1988 | Egan et al. |
| 5,070,634 | A | 12/1991 | Marino |
| 5,212,327 | A | 5/1993 | Schuemann |
| 5,467,550 | A | 11/1995 | Mumbleau |
| 5,519,954 | A | 5/1996 | Garrett |
| 5,520,019 | A | 5/1996 | Schuetz |
| 6,311,603 | B1 | 11/2001 | Dunlap |
| 6,405,722 | B2 | 6/2002 | Colby |

(Continued)

FOREIGN PATENT DOCUMENTS

| | | |
|---|---|---|
| EP | 0185763 B1 | 3/1991 |
| EP | 0185087 B1 | 10/1991 |

(Continued)

*Primary Examiner* — Joshua E Freeman

(74) *Attorney, Agent, or Firm* — Boyle Fredrickson, S.C.

(57) ABSTRACT

A firearm receiver assembly that includes a magazine release assembly, a bolt release assembly, a safety switch assembly, and a charging handle assembly and wherein at least one of the magazine release assembly, the bolt release assembly, the safety switch assembly, and the charging handle assembly are ambidextrously operable from each of a right hand side and a left hand side of the resultant firearm.

20 Claims, 11 Drawing Sheets

(56) References Cited

U.S. PATENT DOCUMENTS

| | | | |
|---|---|---|---|
| 7,240,600 | B1 | 7/2007 | Bordson |
| 7,418,898 | B1 | 9/2008 | Desomma |
| 7,421,937 | B1 | 9/2008 | Gangl |
| 7,461,581 | B2 | 12/2008 | Leitner-Wise |
| 7,596,900 | B2 | 10/2009 | Robinson et al. |
| 7,654,187 | B2 | 2/2010 | Hochstrate et al. |
| 7,661,219 | B1 | 2/2010 | Knight, Jr. et al. |
| 7,661,220 | B2 | 2/2010 | Crandall et al. |
| D614,718 | S | 4/2010 | Hoel |
| 7,707,921 | B1 | 5/2010 | Hoel |
| 7,798,045 | B1 | 9/2010 | Fitzpatrick et al. |
| 7,806,039 | B1 | 10/2010 | Gomez |
| 7,819,052 | B2 | 10/2010 | Zedrosser |
| 7,832,322 | B1 | 11/2010 | Hoel |
| 7,832,326 | B1 | 11/2010 | Barrett |
| 7,849,777 | B1 | 12/2010 | Zedrosser |
| 7,856,917 | B2 | 12/2010 | Noveske |
| 7,861,635 | B1 | 1/2011 | Hoel |
| 7,874,240 | B2 | 1/2011 | Akhavan |
| 7,891,284 | B1 | 2/2011 | Barrett |
| 7,921,587 | B2 | 4/2011 | Mayberry |
| 7,921,750 | B2 | 4/2011 | Tankersley |
| 7,926,404 | B2 | 4/2011 | Brittingham |
| 7,975,418 | B2 | 7/2011 | Curry |
| 7,992,335 | B2 | 8/2011 | Gangl |
| 8,033,043 | B2 | 10/2011 | McGarry |
| 8,047,119 | B2 | 11/2011 | Hochstrate et al. |
| 8,096,074 | B2 | 1/2012 | Robinson et al. |
| 8,104,393 | B2 | 1/2012 | Kincel |
| 8,127,481 | B2 | 3/2012 | Rozum et al. |
| 8,141,474 | B2 | 3/2012 | Dublin |
| 8,156,854 | B2 | 4/2012 | Brown |
| 8,161,861 | B2 | 4/2012 | Haley et al. |
| 8,166,691 | B1 | 5/2012 | Karfiol |
| 8,201,489 | B2 | 6/2012 | Juarez |
| 8,225,705 | B2 | 7/2012 | Dubois et al. |
| 8,245,626 | B2 | 8/2012 | Langevin |
| 8,261,649 | B2 | 9/2012 | Fitzpatrick et al. |
| 8,261,652 | B2 | 9/2012 | Findlay |
| 8,276,502 | B1 | 10/2012 | Wright |
| 8,296,984 | B2 | 10/2012 | Kincel |
| 8,307,750 | B2 | 11/2012 | Vuksanovich et al. |
| 8,312,668 | B2 | 11/2012 | Kincel |
| 8,327,749 | B2 | 12/2012 | Underwood |
| 8,333,028 | B1 | 12/2012 | Karfiol et al. |
| 8,336,436 | B2 | 12/2012 | Kincel |
| 8,342,075 | B2 | 1/2013 | Gomez |
| 8,356,537 | B2 | 1/2013 | Kincel |
| 8,359,966 | B1 | 1/2013 | Brotherton |
| 8,381,628 | B1 | 2/2013 | Wheatley |
| 8,393,259 | B2 | 3/2013 | Larue |
| D682,383 | S | 5/2013 | Underwood |
| 8,443,711 | B2 | 5/2013 | Clark et al. |
| 8,468,929 | B2 | 6/2013 | Larson et al. |
| 8,490,309 | B2 | 7/2013 | Zukowski |
| 8,499,482 | B1 | 8/2013 | Di Trolio |
| 8,505,428 | B2 | 8/2013 | Overstreet et al. |
| 8,505,433 | B2 | 8/2013 | Hochstrate et al. |
| 8,528,458 | B2 | 9/2013 | Windauer |
| 8,549,982 | B2 | 10/2013 | Troy, Jr. et al. |
| 8,561,517 | B2 | 10/2013 | Brown |
| D694,354 | S | 11/2013 | Underwood |
| 8,584,575 | B2 | 11/2013 | Crommett |
| 8,590,201 | B2 | 11/2013 | Brixius |
| 8,596,185 | B1 | 12/2013 | Soong et al. |
| 8,607,688 | B2 | 12/2013 | Cassels |
| 8,635,799 | B2 | 1/2014 | Azhocar |
| 8,640,372 | B2 | 2/2014 | Hochstrate et al. |
| 8,640,598 | B1 | 2/2014 | Jackson |
| 8,650,789 | B2 | 2/2014 | Dionne et al. |
| 8,650,790 | B2 | 2/2014 | Dionne et al. |
| 8,701,327 | B2 | 4/2014 | Kincel |
| 8,820,210 | B2 | 9/2014 | Melville |
| 8,887,612 | B2 | 11/2014 | Bayly |
| 9,121,651 | B1 | 9/2015 | Jen |
| 2006/0123683 | A1 | 6/2006 | Garrett et al. |
| 2006/0265925 | A1 | 11/2006 | Murello |
| 2006/0283318 | A1 | 12/2006 | Beaty |
| 2008/0302235 | A1 | 12/2008 | Lauck |
| 2010/0212201 | A1 | 8/2010 | Kincel et al. |
| 2010/0218671 | A1 | 9/2010 | Mayberry et al. |
| 2010/0251591 | A1 | 10/2010 | Burt et al. |
| 2010/0287806 | A1 | 11/2010 | Marfione et al. |
| 2011/0005383 | A1 | 1/2011 | Kramer |
| 2011/0056107 | A1 | 3/2011 | Underwood |
| 2011/0174139 | A1 | 7/2011 | Olsen et al. |
| 2011/0283580 | A1 | 11/2011 | Esch |
| 2012/0006188 | A1 | 1/2012 | Kincel |
| 2012/0152104 | A1 | 6/2012 | Audibert et al. |
| 2012/0167424 | A1 | 7/2012 | Gomez |
| 2012/0167757 | A1 | 7/2012 | Gomez |
| 2012/0180647 | A1 | 7/2012 | Dublin |
| 2012/0198742 | A1 | 8/2012 | Troy et al. |
| 2012/0198990 | A1 | 8/2012 | Brittin |
| 2012/0279384 | A1 | 11/2012 | Hochstrate et al. |
| 2012/0279385 | A1 | 11/2012 | Dieckmann |
| 2012/0291326 | A1 | 11/2012 | Bova |
| 2012/0297656 | A1 | 11/2012 | Langevin et al. |
| 2012/0325044 | A1 | 12/2012 | Brown |
| 2013/0092014 | A1 | 4/2013 | Kincel |
| 2013/0098235 | A1 | 4/2013 | Reinken |
| 2013/0152442 | A1 | 6/2013 | Underwood |
| 2013/0152444 | A1 | 6/2013 | Tatum |
| 2013/0174721 | A1 | 7/2013 | Langevin et al. |
| 2013/0192113 | A1 | 8/2013 | Melville |
| 2013/0227869 | A1 | 9/2013 | Thordsen |
| 2013/0269232 | A1 | 10/2013 | Harris et al. |
| 2013/0284008 | A1 | 10/2013 | Pizano |
| 2013/0326924 | A1 | 12/2013 | Jarboe et al. |
| 2014/0000446 | A1 | 1/2014 | Hail |
| 2014/0013640 | A1 | 1/2014 | Munson |
| 2014/0020549 | A1 | 1/2014 | Bayly |
| 2014/0230298 | A1 | 8/2014 | King, Jr. |
| 2014/0237878 | A1 | 8/2014 | Lambert |
| 2014/0317980 | A1 | 10/2014 | Michel |
| 2014/0325886 | A1 | 11/2014 | Mather |
| 2015/0323271 | A1 | 11/2015 | McGinty |
| 2015/0330733 | A1 | 11/2015 | DeSomma et al. |
| 2016/0069628 | A1 | 3/2016 | Fluhr et al. |
| 2016/0116242 | A1 | 4/2016 | McGinty |

FOREIGN PATENT DOCUMENTS

| | | | |
|---|---|---|---|
| EP | 0902248 | A3 | 9/2000 |
| EP | 0834052 | B1 | 7/2002 |
| EP | 0894234 | B1 | 9/2003 |
| EP | 2122291 | B1 | 6/2010 |
| EP | 1586848 | B1 | 9/2010 |
| EP | 2409108 | B1 | 5/2013 |
| EP | 2029954 | B1 | 7/2013 |
| EP | 2631589 | A1 | 8/2013 |
| EP | 2179244 | B1 | 10/2013 |
| EP | 2446212 | B1 | 10/2013 |
| EP | 1718913 | B1 | 12/2013 |
| EP | 2693156 | A2 | 2/2014 |
| WO | 2007090611 | A1 | 8/2007 |
| WO | 2008/137187 | A3 | 11/2008 |
| WO | 2008137187 | A2 | 11/2008 |
| WO | 2010123604 | A3 | 10/2010 |
| WO | 2013088198 | A1 | 6/2013 |
| WO | 2013103428 | A2 | 7/2013 |
| WO | 2013103428 | A3 | 7/2013 |
| WO | 2013119291 | A1 | 8/2013 |
| WO | 2013136112 | A3 | 9/2013 |
| WO | 2013173871 | A1 | 11/2013 |
| WO | 2014021959 | A2 | 6/2014 |

AMBIDEXTROUSLY OPERABLE FIREARM RECEIVER ASSEMBLY

CROSS-REFERENCE TO RELATED APPLICATION

This application is a continuation of U.S. patent application Ser. No. 14/669,260, filed on Mar. 26, 2015, having the same title, and the entirety of which is incorporated herein.

FIELD OF THE INVENTION

The present invention relates generally to firearms and, more particularly, to a firearm receiver assembly and charging handle that accommodate right and left hand operation of the various control features associated with operation of an underlying firearm.

BACKGROUND OF THE INVENTION

Although some firearm users are ambidextrous and can efficiently and accurately operate right or left handed firearms, it is readily appreciated that many firearms are provided in right-hand and left-hand models. The respective hand nomenclature is used to designate use of the firearm by the respective dominant hand of the shooter being associated with the trigger and/or stock. Such a designation allows use of the shooters dominant eye for sighting and positions the controls associated with operation of the firearm, such as safeties, magazine catches, bolt catches and casing discharge openings for comfortable interaction and operation by the shooter. Providing firearms in right and left hand model constructions increases manufacturing costs and requires attention by consumers to a firearm having the appropriate or desired right handed or left handed construction.

In an effort to improve manufacturing efficiencies and provide more uniform product platforms, some manufacturers provide what have been termed ambidextrously operable firearms but some such firearms fail to adequately consider the orientation of the shooter and the shooters hands to the both the firearm and each of the controls associated with sustained operation of the firearm. Such considerations are more endemic in rifle configuration and particularly semi or fully automatic firearms wherein maintaining a visual target acquisition is commonly preferred or desired even during interaction with one or more of the controls associated with operation of the underlying firearm. In repeat fire rifle configurations, such controls can commonly include a safety selector, a bolt catch or release, a magazine catch or release, and operation of a charging handle to maintain a desired ready to discharge configuration of the underlying firearm.

As is commonly appreciated, the safety selector is commonly associated with a live position wherein discharge of the firearm is possible with subsequent actuation of the trigger and a safe condition wherein operation of the trigger is disabled or otherwise interfered with such that the trigger cannot be actuated even if a round is present in the chamber. The magazine catch or release secures a magazine relative to the receiver and is operable such that actuation of the magazine catch allows removal of a magazine from the firearm and subsequent engagement of a replacement or reloaded magazine with the receiver.

The bolt catch or bolt release cooperates with the bolt and leaves the action open upon discharge of a last round such that, actuation of the bolt release closes the action in a manner wherein movement of the bolt into battery introduces a subsequent round of ammunition to the chamber from a replacement magazine. The charging handle cooperates with the bolt and allows the shooter to manually manipulate the position of the bolt for an open position to a battery position for activities such as cocking the hammer or firing pin, discharging an unspent or misfired cartridge, inspection of the bore, chamber or action, clearing a stoppage such as a jam or miss feed, and allows the action to be closed while simultaneous introducing a subsequent round.

Interaction with one or more of the control functions described above can be rendered physically awkward or difficult depending on the orientation of the control relative to the dominant hand of the shooter. Many self asserted ambidextrously operable firearm assemblies fail to include ambidextrous controls for each of the operational structures of the firearm such that, during some instances, the shooter must attain a somewhat awkward position to interact with the respective control arrangement or even fully dissociate the firearm from a firing position to attain an orientation wherein the shooter can interact with the respective control arrangement. Such problems are exacerbated in instances of firearms configured primarily for right handed or left handed shooters and operated by the other of a right handed or left handed shooter.

Another concern associated with providing ambidextrous control of a firearm is associated with reducing the potential for inadvertent actuation of any given control arrangement. That is to say, some ambidextrously operable firearm control arrangements are provided in configurations wherein very limited deviation from a prescribed shooting position can result in inadvertent operation of one or more of the controls provided to accommodate shooters of the other dexterity. Such concerns can be exacerbated during combat situations where such undesired or unintentional interaction with one or more of the control arrangements configured for shooters of the alternate dexterity can have serious consequences to the efficacy of a present shooter.

Therefore, there is a need for a firearm that is constructed to be operated by right handed or left handed shooters and which provides ambidextrous interaction with each of the controls associated with operation of the firearm and does so in a manner that provides an orientation of the respective control inputs such that the respective "right hand" firearm controls do not interfere with or be inadvertently operable by left handed shooters, and vice versa.

SUMMARY OF INVENTION

The present invention discloses a firearm that it ambidextrously operable and overcomes one or more of the disadvantages disclosed above. One aspect of the invention discloses a firearm receiver assembly that includes one or more of a magazine release assembly, a bolt release assembly, a safety switch assembly, and a charging handle assembly and wherein the at least one of the magazine release assembly, the bolt release assembly, the safety switch assembly, and the charging handle assembly are operable from each of a right hand side and a left hand side of the resultant firearm.

Another aspect of the invention that is useable or combinable with one or more of the above features discloses a firearm receiver assembly that includes a receiver body having a forward oriented portion that defines a magazine cavity that is shaped to slidably cooperate with a magazine. The receiver body includes a first side wall and a second side wall that are oriented on opposite lateral sides of the magazine cavity. A trigger guard is defined by the receiver body and extends in a downward direction rearward of the forward oriented portion of the receiver body. A bolt catch assembly extends in a lateral direction across the receiver body. The bolt catch assembly a first operator and a second operator that are operable from respective opposite lateral sides of the receiver body. The first operator includes a first portion that defines a bolt catch and a second portion that defines an actuator such that the actuator and the bolt catch are on opposite sides of the first side wall of the receiver body. A post extends from the first operator in a direction toward the second side wall of the receiver body. The second operator is associated with the second side wall of the receiver body and defines an opening that is circumferentially bounded by the second operator. The opening associated with the second operator slidably cooperates with the post defined by the first operator such that operation of either of the first operator or the second operator moves the bolt catch out of interference with a bolt of a firearm.

Another aspect of the invention that is usable or combinable with one or more of the above aspects discloses a firearm receiver assembly that includes a lower receiver body that defines a magazine cavity that is constructed to removably cooperate with a magazine. The receiver assembly supports a magazine catch assembly that is operable from opposite lateral sides of the lower receiver body to release a magazine from the lower receiver body. The magazine catch assembly includes a base having a tang that is disposed proximate one end of base. The tang is configured to selectively engage a magazine to secure a magazine relative to the magazine cavity when the tang is engaged with a magazine. The base is further defined as being laterally movable relative to the lower receiver body. A first magazine release operator extends from an opposite end of the base across the lower receiver body. The first magazine release is operable from outside the lower receiver body and slidable relative to the lower receiver body to selectively bias the tang out of engagement with a magazine. The assembly includes a second magazine release operator that is disposed on a common side of the lower receiver body as the base and pivotably connected to the lower receiver body such that rotation of the second magazine release operator selectively biases the tang out of engagement with a magazine.

Another aspect of the invention that is usable or combinable with one or more of the above aspects discloses a method of forming an ambidextrously operable firearm receiver assembly. The method includes providing a lower receiver body. A magazine catch assembly is provided that includes a first magazine release operator and a second magazine release operator. The magazine catch assembly cooperates with the lower receiver body such that the magazine catch assembly is operable from opposite lateral sides of the lower receiver body to release a magazine from the lower receiver body. The first magazine release operator is slidable relative to the lower receiver body and the second magazine release operator is pivotable relative to the lower receiver body. A bolt catch assembly is provided that includes a first bolt release operator and a second bolt release operator. The bolt catch assembly cooperates with the lower receiver body such that the bolt catch assembly is operable from opposite lateral sides of the lower receiver body to release the bolt. The first bolt release operator is pivotable about a first pivot axis relative to the lower receiver body and the second bolt release operator is pivotable relative to the lower receiver body about a second pivot axis that is oriented in a crossing direction relative to the first pivot axis.

These and other features, aspects, and advantages of the present invention will be better understood from the following brief description of the drawings, drawings, and detailed description of the preferred embodiments of the present invention.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENT

Figure 1:
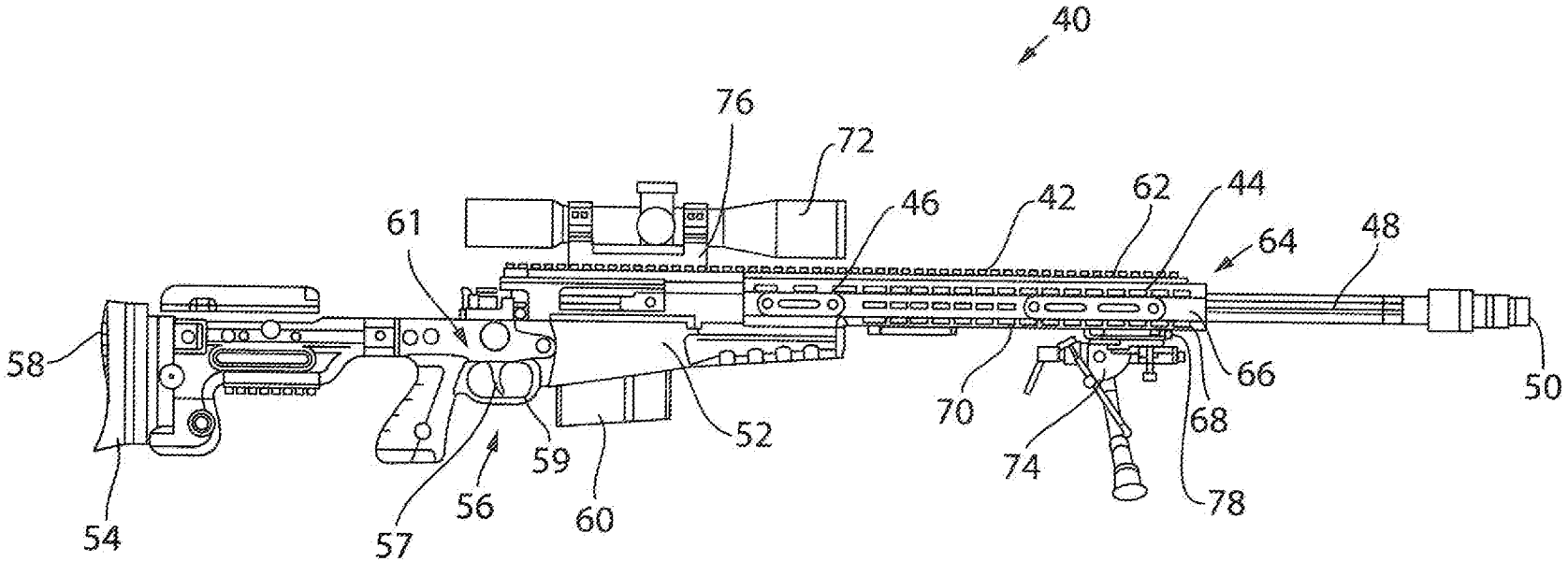
FIG. 1 is a side elevation view of an exemplary firearm equipped with a receiver assembly according to one embodiment to the present invention.

FIG. 1 shows a firearm assembly or simply a firearm 40 equipped with a receiver assembly 52 according to one embodiment of the present invention. Firearm 40 includes a barrel 48 that extends between a muzzle 50 and receiver or receiver assembly 52. A stock 54 extends generally rearward from receiver assembly 52. Receiver assembly 52 supports a trigger assembly 56 such that trigger assembly 56 is disposed between a butt 58, defined by stock 54 of firearm 40, and barrel 48. Trigger assembly 56 includes a trigger body 57 that is preferably bounded by a trigger guard 59 configured to limit unintended interaction with trigger body 57.

Firearm 40 includes a magazine 60 that is commonly associated with accommodating multiple rounds of ammunition and is commonly removable from receiver assembly 52. As is commonly understood, user interaction with trigger body 57 of trigger assembly 56 is associated with discharging firearm 40 when a fire control selector assembly or selector 61, commonly termed a SAFETY or FIRE selector, is disposed in one or more FIRE of LIVE position(s). As disclosed further below, it is appreciated that safety 61 can be provided in various configurations intended to accommodate a no-fire or safe condition, a semiautomatic fire condition, a burst fire condition, and/or a fully automatic fire condition. Those skilled in the art readily appreciate that the respective fire conditions are termed in a manner indicative of a discharge rate or an inability to discharge ammunition from firearm 40 via user or shooter interaction with trigger body 57.

In some configurations, a hand guard 42 extends along barrel 48 generally forward of receiver assembly 52 and includes one or more rows of engagement interfaces 62, 64, 66, 68, 70 and/or mount adapters 44, 46 associated with securing accessories to firearm 40. One or more accessories 72, 74, such as optics, such as a site or a scope 72, or other accessories such as a bi-pod 74, can be associated with a respective accessory mount devices 76, 78 that is disposed between the respective accessory 72, 74 and the underlying accessory engagement interface.

Each accessory mount device 76, 78 is constructed to securely cooperate with a respective engagement interface 62, 64, 66, 68, 70 associated with the underlying hand guard 42. Although shown as a scope and a bi-pod, it is appreciated that various accessories, such as lights, other sighting devices, supplemental munitions, etc., can be supported by hand guard 42 or other portions of firearm 40 provided the respective accessories are configured to cooperate with or be secured to a respective engagement interface 62, 64, 66, 68, 70 associated with hand guard 42 or other structures of firearm 40. It is appreciated that receiver assembly 52 as described hereafter can be configured to be useable with firearms of various configurations, various calibers, and with various accessories. As described hereafter, firearm receiver assembly 52 is configured to accommodate ambidextrous operation of various control features associated with an intended or desired use of firearm 40.

Figure 2:
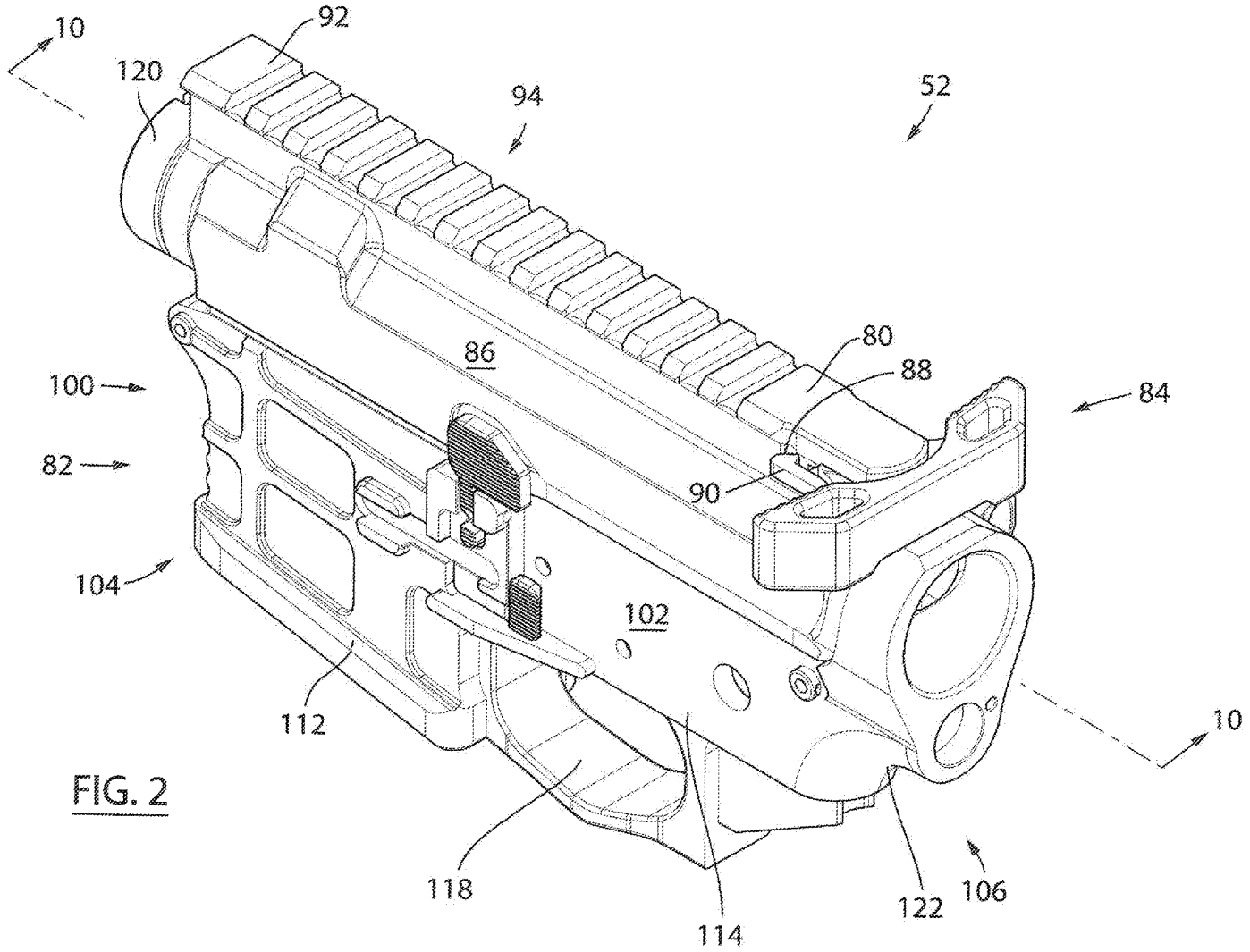
FIG. 2 is rear left side perspective view of the receiver assembly shown in FIG. 1 with the barrel and stock assemblies removed therefrom.
Figure 3:
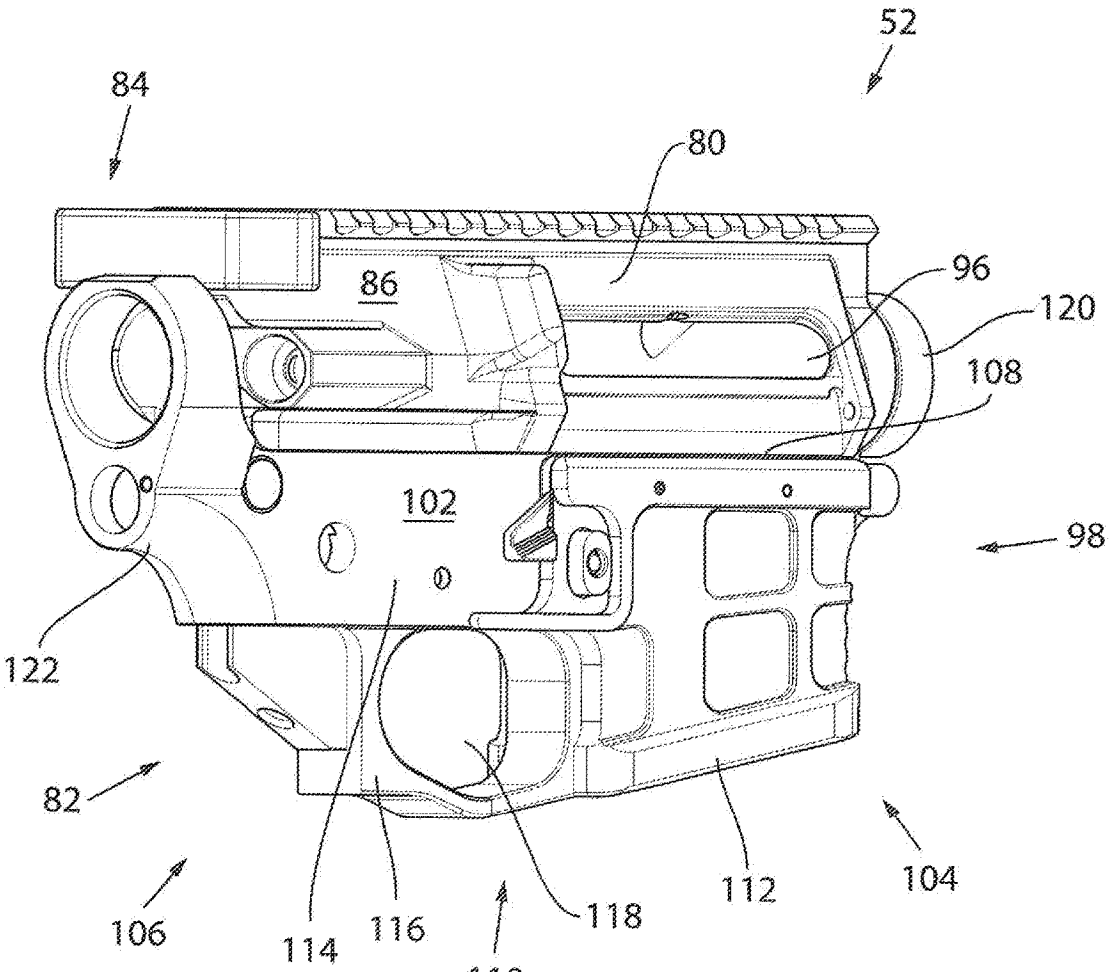
FIG. 3 a rear right side perspective view of the receiver assembly shown in FIG. 2.

FIGS. 2 and 3 show the barrel and stock structures associated with firearm 40 removed from receiver assembly 52. Receiver assembly 52 includes an upper receiver 80, a lower receiver assembly 82, and a charging handle assembly 84 that slidably cooperates with receiver assembly 52. Upper receiver 80 is defined by a body 86 and is shaped to slidably cooperate with charging handle assembly 84. Upper receiver body 86 includes a detent, cavity or recess 88 that is positioned and shaped to cooperate with a catch 90 associated with charging handle assembly 84. When engaged, the cooperation between catch 90 and recess 88 secure charging handle assembly 84 in a forward orientation relative to firearm 40.

An upper surface 92 of upper receiver 80 includes an optional engagement interface 94 associated with attaching one or more accessories associated with operation and/or usage of firearm assembly 40. Upper receiver body 86 defines an ejection opening or port 96 (FIG. 3) associated with discharging spent shell casings, or removing non-discharged rounds, from firearm assembly 40. Although shown as facing toward a right-hand side 98 of receiver assembly 52, it is appreciated that upper receiver body 86 can be constructed with a left-side facing ejection port 96 or an ejection opening oriented toward a left-hand side 100 (FIG. 2) of receiver assembly 52 to better accommodate left-handed shooters.

Lower receiver assembly 82 is defined by a body 102 having a forward facing end 104 and a rearward facing end 106. As used herein, the relative forward, rearward, right hand and left hand designations are described relative to a discharge direction associated with muzzle 50 of firearm assembly 40. An upper facing side 108 of lower receiver body 102 is shaped to removably cooperate with upper receiver body 86 whereas a lower firing side 110 of lower receiver body 102 defines a magazine portion 112, configured to removably cooperate with a magazine, and a trigger assembly portion 114, associated with accommodating a trigger assembly operative in response to actuation of trigger body 57.

Trigger assembly portion 114 of lower receiver body 102 defines a trigger guard 116 configured to generally circumscribes a trigger opening 118 that is configured to accommodate the users interaction with trigger body 57 of firearm assembly 40. Trigger guard 116 could be integrally formed with lower receiver body 102 or removable therefrom. It is further appreciated that trigger guard 116 could be formed as a portion of the trigger assembly configured to removably cooperate with lower receiver body 102. A forward facing end 120 of upper receiver body 86 is constructed to cooperate with the barrel of firearm assembly 40 and a rearward facing portion 122 of lower receiver body 102 is constructed to accommodate securing of a stock assembly to receiver assembly 52.

Figure 4:
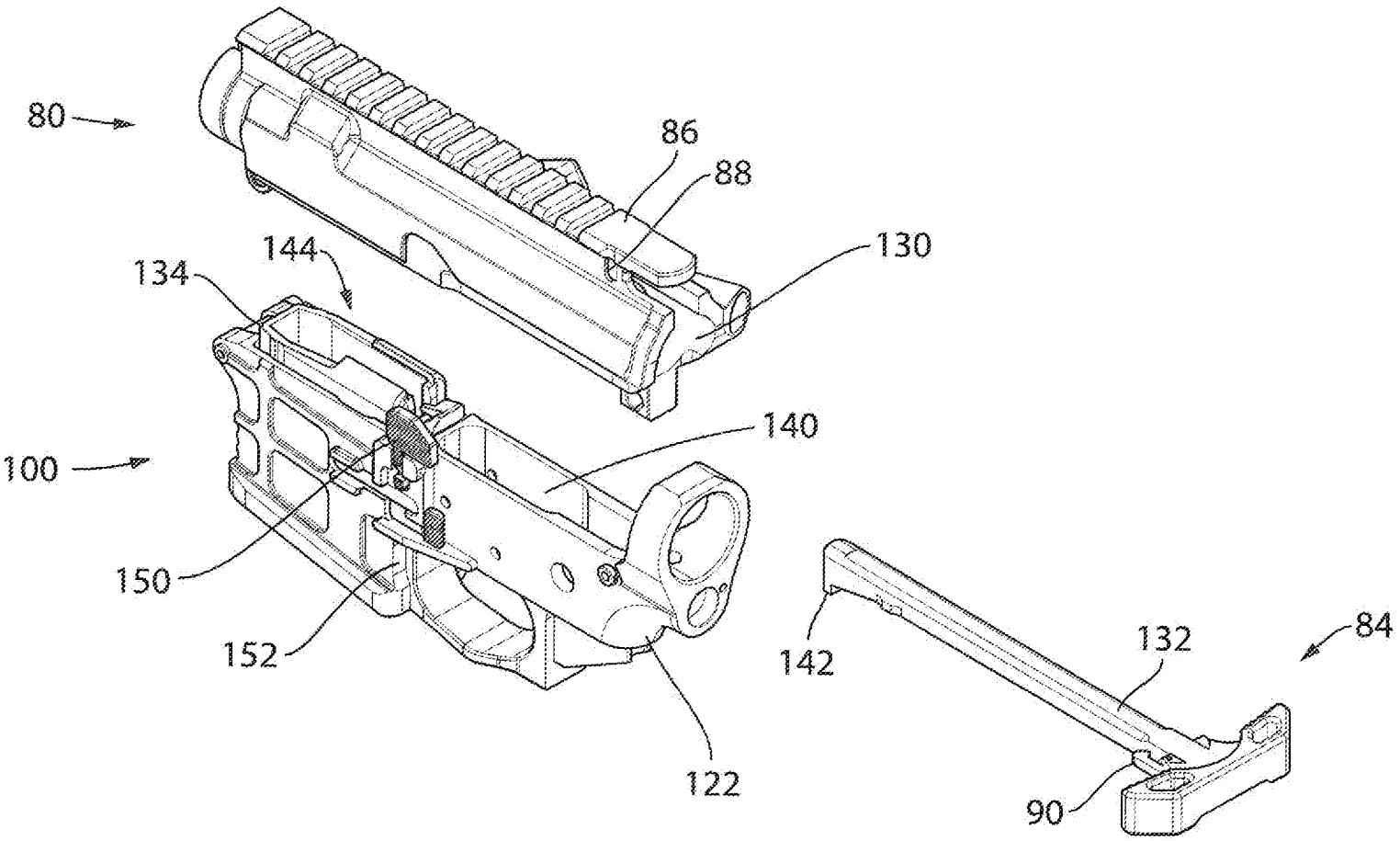
FIG. 4 is a partially exploded perspective view of the receiver assembly shown in FIG. 2.
Figure 5:
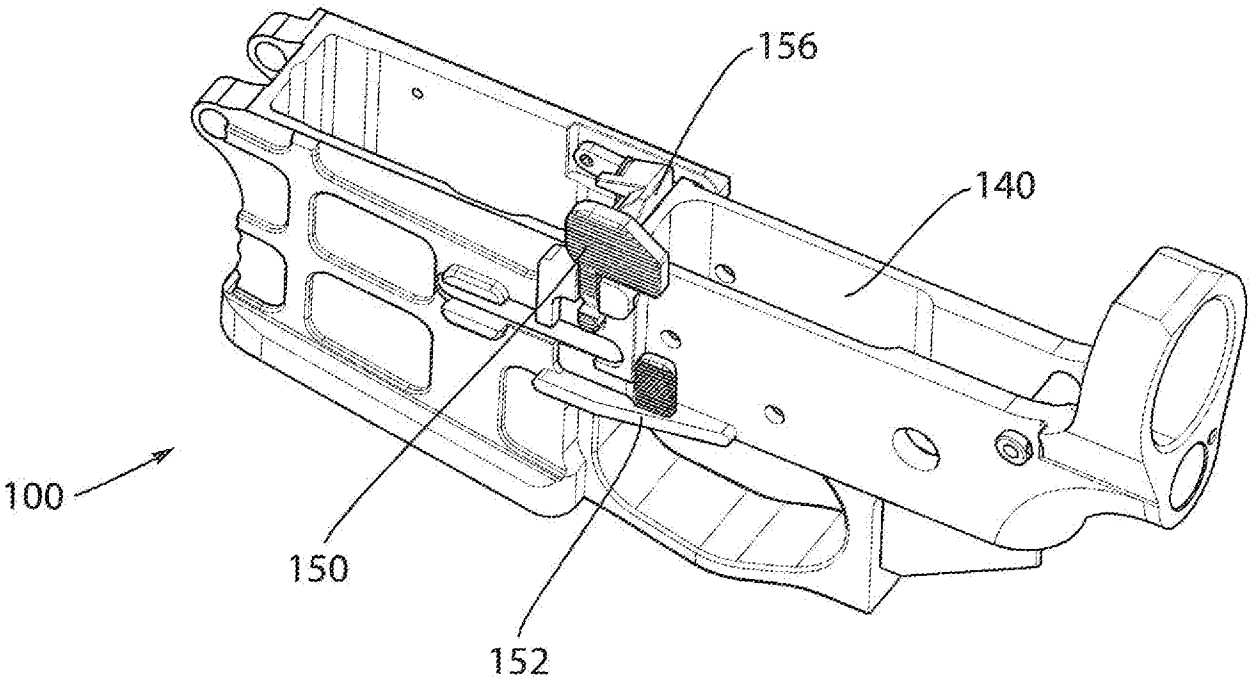
FIG. 5 is a perspective view similar to FIG. 2 of the lower receiver assembly shown in FIG. 4.

Referring to FIG. 4, upper receiver 80 defines a channel 130 constructed to slidably cooperate with an elongated portion or a stem 132 of charging handle assembly 84. Charging handle assembly 84 cooperates with firearm assembly 40 to accommodate rearward manual translation of a bolt of firearm assembly 40 relative to the firing chamber. Lower receiver assembly 52 is constructed to removably cooperate with a magazine 134 that slidably cooperates with a magazine chamber defined by the lower receiver body 102.

As mentioned above, lower receiver assembly 52 includes a trigger assembly cavity or chamber 140 configured to receive a trigger assembly associated with discharging a firearm 40. When fully assembled, an arm or projection 142 associated with charging handle assembly 84 slidably cooperates with opening 144 defined by magazine 134 to accommodate manual translation of the bolt associated with firearm assembly 40 and the introduction and/or extraction of shells and/or shell casings associated therewith or the introduction of at least an initial round of ammunition to the firing chamber of firearm 40. When catch 90 of charging handle 84 is engaged with recess 88 defined by upper receiver body 86, repeat discharge a firearm assembly 40 can be accommodated by the oscillation of the bolt relative to opening 144 of magazine 134 without user interaction with charging handle assembly 84.

Receiver assembly 52 is constructed to support a bolt catch/release assembly 150, a magazine catch/release assembly 152, as well as firing safety assembly 61. As described further below, each of bolt catch/release assembly 150, magazine catch/release assembly 152, and safety assembly 61 are constructed to be operable from alternate lateral sides of receiver assembly 52. During certain situations associated with operation of firearm assembly 40, such as a misfire or exhaustion of available ammunition associated with magazine 134, the bolt periodically achieves an interfering orientation with a catch 156 associated with bolt catch/release assembly 150 which holds the action open for clearing of jams and/or reloading operations. User interaction with bolt catch/release assembly 150 allows subsequent forward translation of the bolt relative to the firing chamber so as to close the action and/or chambering of a subsequent round of ammunition. Lower receiver assembly 82 also includes a magazine catch/release assembly 152 that is operable to allow the selective removal and/or replacement of magazines 134 during usage of firearm assembly 40.

Referring to FIGS. 5-9, lower receiver body 102 includes a first channel or recess 160 that is shaped to accommodate the structures associated with bolt catch/release assembly 150. Bolt catch/release assembly 150 includes a first operator 162 and the second operator 164 that interact with one another so as to manipulate the orientation of catch 156 during actuation of either of operators 162, 164. First operator 162 includes a paddle 166 oriented to extend from a first lateral side of lower receiver body 102. Recess 160 of lower receiver body 102 includes a channel 168 constructed to cooperate with a pivot or roll pin 170 configured to pass through an opening 172 defined by first operator 162 such that first operator 162 is pivotably connected to lower receiver body 102. Bolt catch 156 is integrally formed with first operator 162 and extends in a crossing direction relative to the axis defined by pin 170.

A post 176 is formed proximate an end 181 associated with operator 162 and shaped to cooperate with a cavity 180 defined by second operator 164. Post 176 is circumferentially bounded by opening 180 defined by second operator 164 such that manual interaction with operator 164 effectuates translation of catch 156 associated with first operator 162. Such a construction also avoids operational separation between the first and second actuators or operators 162, 164 associated with manual manipulation of catch 156. A second pivot or roll pin 184 cooperates with an opening 186 associated with second operator 164 such that the cooperation between opening 180 and post 176 is disposed between the axis associated with pin 184 and a button or paddle 191 defined by second operator 164 of bolt catch/release assembly 150.

Figure 6:
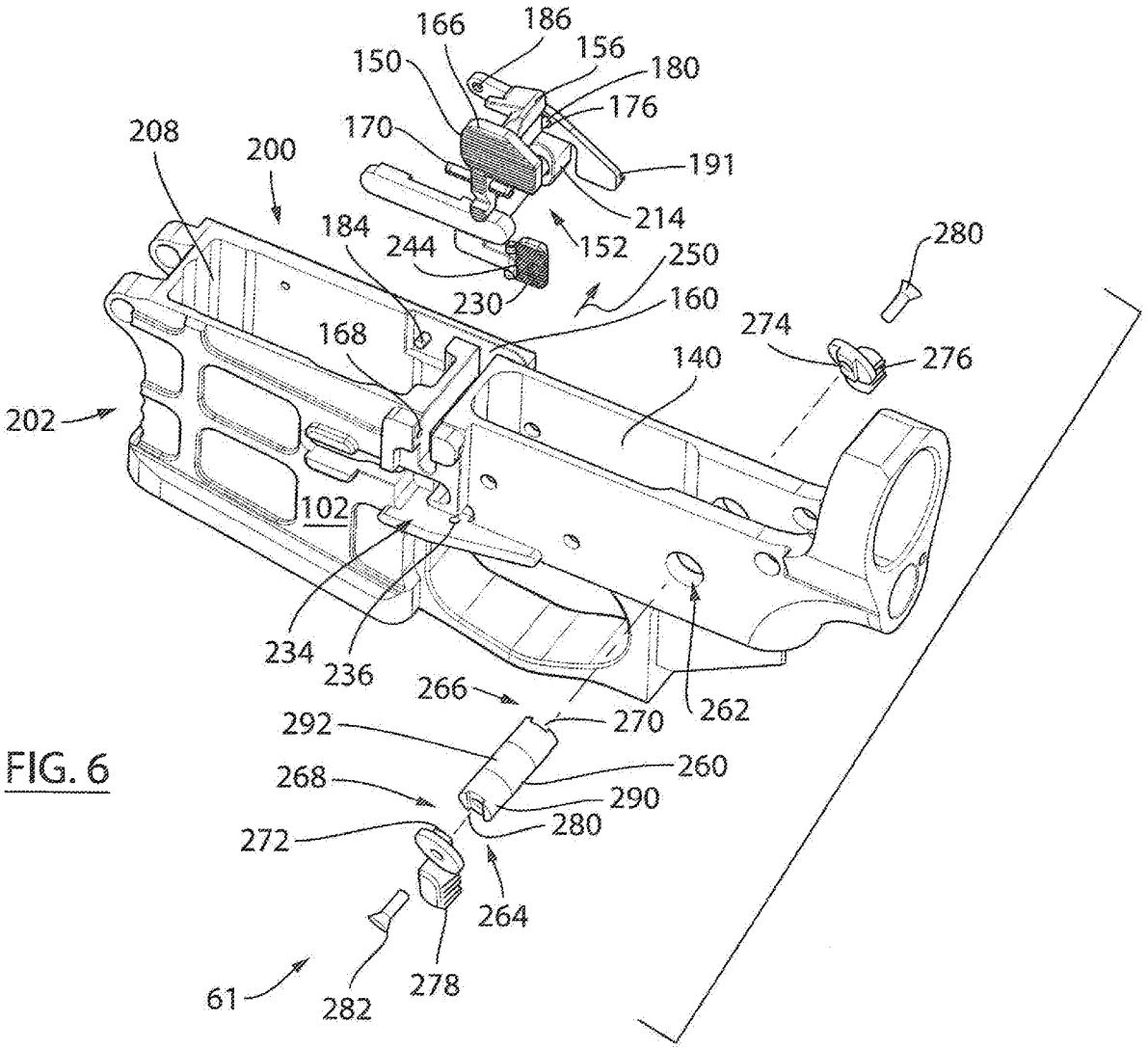
FIG. 6 is a perspective view similar to FIG. 5 with a bolt catch or release assembly and a magazine catch or release assembly exploded from a lower receiver body.
Figure 8:
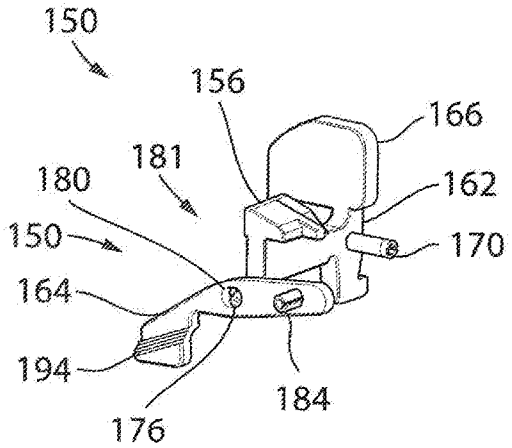
FIG. 8 is a perspective view of the bolt catch or release assembly shown in FIG. 7.
Figure 7:
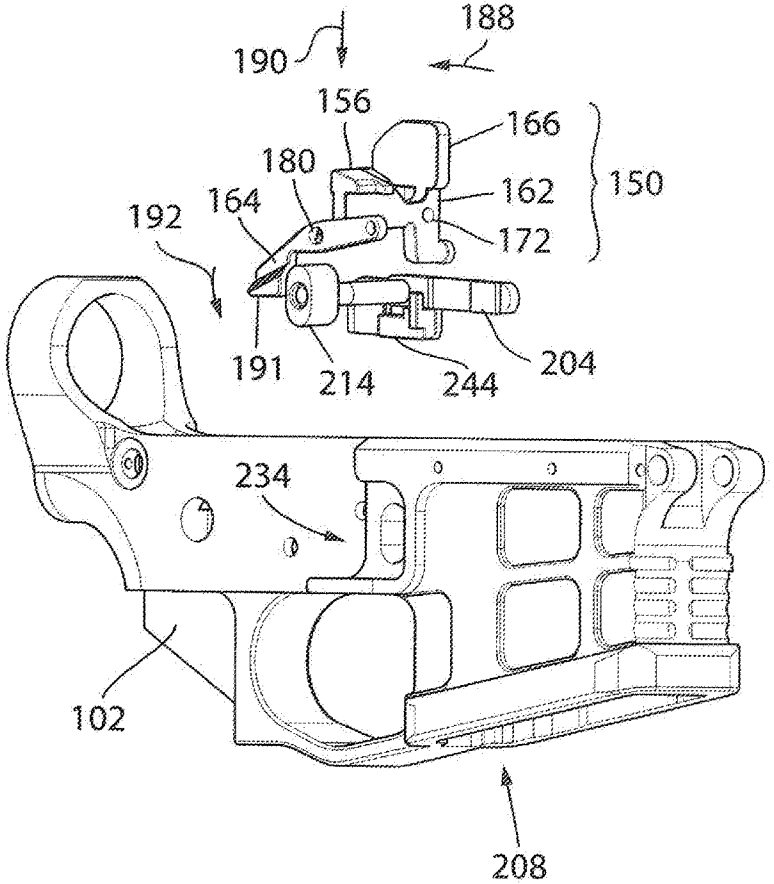
FIG. 7 is an alternate perspective view of FIG. 5.

Referring to FIGS. 6-8, when engaged with lower receiver body 102, paddle 166 associated with first operator 162 is rotatable about the axis defined by pin 170 in a generally inward lateral direction, indicated by arrow 188, so as to effectuate generally downward, indicated by arrow 190, translation of catch 156 such that catch 156 no longer positionally interferes with the forward translation of the bolt of firearm assembly 40. In a similar manner, the generally downward rotation of second operator 164, indicated by arrow 192, about the axis defined by pin 184 effectuates downward lateral translation 190 of catch 156 to effectuate the same resultant operation associated with the forward translation of the bolt the firearm assembly 40.

It should be appreciated from FIG. 6 that paddle 166 associated with first operator 162 is accessible from what would be the left hand lateral side of firearm assembly 40 whereas paddle 191 associated with second operator 164 would be accessible from the right-hand lateral side of lower receiver body 102 thereby accommodating operation and/or manipulation of catch 156 from both of the alternate lateral sides, 200, 201 of lower receiver body 102 thereby providing an ambidextrously operable bolt catch assembly or bolt catch assembly that can be operated via interaction from only one of the alternate lateral sides of underlying firearm assembly.

It should be appreciated that the axis of rotation associated with first operator 162 and the axis of rotation associated with second operator 164 are oriented in orthogonal or crossing directions relative to one another. It should be further appreciated that post 176 extends in a crossing direction relative to each of the axes associated with pins 170, 184 but has an orientation that is nearer the relative axis associated with pin 184 than the axis associated with pin 170. It is further appreciated that one or more biasing devices, such as a compression or torsion spring, may be disposed between one or both of operators 162, 164, associated with bolt catch/release assembly 150, so as to maintain a desired orientation of catch 156 relative to the longitudinal axial displacement associated with operation of the bolt a firearm assembly 40 relative to one another and/or the generally movable orientation of the respective operators relative to recess 160 associated with lower receiver body 102. It is further appreciated that catch 156 can be configured to interact with the bolt in a manner wherein no bias is required to maintain catch 156 in a respective engaged or disengaged position relative thereto.

Figure 9:
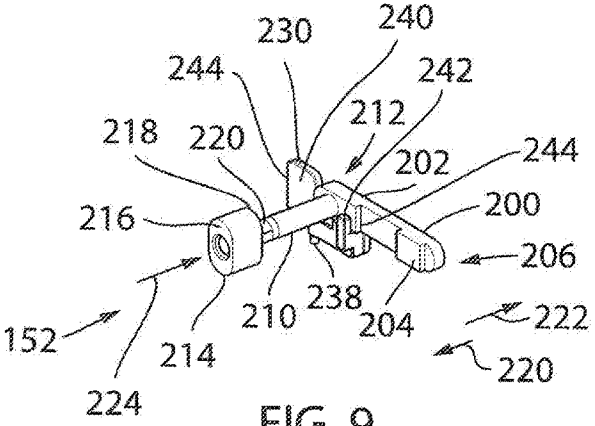
FIG. 9 is a perspective view of the magazine catch or release assembly shown in FIG. 7.

Referring now to FIGS. 5-7 and 9, lower receiver body 102 is also constructed to accommodate operation of magazine catch/release assembly 152 from alternate lateral sides 200, 201 of lower receiver body 102. As shown in FIG. 9, magazine catch/release assembly 152 includes a catch 203 that is generally defined by an elongate body 202 and a tang or projection 204 that is oriented nearer one respective end 206 of body 202. Projection 204 is constructed to selectively cooperate with a corresponding detent defined by magazine 134 so as to provide a secure mechanical connection associated with engagement of magazine 134 with magazine cavity 208 (FIG. 6) defined by lower receiver body 102 when a suitably constructed magazine is engaged therewith.

A post 210 extends from body 202 proximate an end 212 thereof that is generally opposite end 206. A first operator 214 is engaged with post 210 and includes at least a face 216 that is accessible from a respective outboard lateral side 200, 201 associated with lower receiver body 102. A biasing device, such as a spring 220, is disposed laterally inboard of operator 214 along post 210 and is configured to be captured between a portion of lower receiver body 102 and an inboard lateral facing side 218 of operator 214. Such a configuration biases projection 204 in a first lateral direction, indicated by arrow 221, but allows displacement of projection 204 in an outward lateral direction, indicated by arrow 222, upon pressing, indicated by arrow 224, of first operator 214. When operator 214 is depressed, projection 204 moves out of interfering engagement with a magazine associated therewith.

A second operator 230 is pivotably supported by lower receiver body 102 and cooperates with magazine catch body 202 to effectuate the selective disengagement of projection 204 from a magazine when actuated from the opposite lateral side of lower receiver body 102. Referring briefly to FIG. 6, lower receiver body 102 defines a cavity 234 that is constructed to accommodate, and pivotably support, second operator 230. Cavity 234 includes a recess or opening 236 shaped to cooperate with a pivot 238, such as a pin or projection, that extends from second operator 230. Second operator 230 is defined by a body 240 that extends at least partially in a direction generally aligned with body 202. The axis associated with pivot 238 accommodates rotation of second operator 230 relative to lower receiver body 102.

A projection 242 extends from second operator 230 into interfering engagement with an interior facing surface 244 associated with body 202. Projection 242 and a button or paddle 246 associated with second operator 230 are preferably on opposite sides of the axis associated with pivot 238 as well as the axis associated with post 210 such that depressing paddle 246 (FIG. 6) in an inboard lateral direction, indicated by arrow 250, effectuates rotation of second operator 230 about the axis associated with pivot 238 such that projection 242 displaces projection 204 associated with body 202 out of interfering engagement with a magazine associated therewith. It should be appreciated from FIGS. 6 and 7 that operator 214 is operable from the right-hand lateral side 200 of lower receiver body 102 whereas operator 230 is operable from the left-hand lateral side 201 of lower receiver body 102 so as to accommodate the removal of a magazine from magazine cavity 208 from either of the right-hand or left-hand lateral sides of lower receiver body 102.

As mentioned above and referring to FIG. 6, lower receiver assembly 82 includes a fire selection or safety switch assembly 61 that is also operable from the alternate left hand and right hand lateral sides 200, 201 of lower receiver assembly 82 associated with usage of firearm 40. SAFE/FIRE selection assembly 61 includes a barrel 260 that cooperates with a cavity or passage 262 defined by lower receiver body 102. Opposite longitudinal ends 264, 266 of barrel 260 include a channel 268, 270 that are each shaped to receive a projection 272, 274 associated with a respective right-hand safety operator 276 and a left-hand safety operator 278. A fastener 282, 284 is shaped to pass through the respective safety operator 276, 278 and cooperate with barrel 260 such that projection 272, 274 associated with the respective operator 276, 278 seats within the respective channel 268, 270 associated with barrel 260 such that rotation of either operator 276, 278 about an axis, indicated by line 280, effectuates rotation of barrel 260 relative to lower receiver body 102. Understandably, the shape of projections 272, 274 and channels 268, 270 is merely exemplary of one geometric shape associated with forming a non-rotational interaction between the respective operator 276, 278 and barrel 260 when the respective operators are secured thereto.

It is further appreciated that other configurations associated with the securing of first and second operators 276, 278 relative to barrel 260 are envisioned and within the scope of the invention. A body 290 of barrel 260 includes a circumferentially non-uniform portion 292 that interacts with a trigger assembly associated with trigger assembly chamber 140 to effectuate the different firing and/or SAFE/FIRE conditions. In its simplest configuration, center portion 292 includes a land associated with center portion 292 which, once rotationally oriented to interact with the trigger assembly in a desired manner, manipulates operation of firearm assembly 40 from a no fire or SAFE condition, a semi automatic fire condition, a burst fire condition, and/or a fully automatic fire condition. From the disclosure above, it should be apparent that each of the SAFE/FIRE condition, the magazine catch or release operation, as well as the bolt catch or release operation associated with utilization of firearm assembly 40 can manipulated from either of the alternate lateral sides 200, 201 associated with a users interaction with firearm assembly 40.

It is further appreciated that right and/or left handed users may prefer interaction with any of respective operators 166, 191, 214, 230, 276, 278 with any of the digits or portions of their hands of either of the hand engaged with trigger body 57 of firearm assembly 40 or a respective digit or portion of a hand associated with their respective "free" hand as user preferences for interaction with the various controls associated with operation of firearm assembly 40 can vary widely. The construction, orientation, and operation of each of operators 166, 191, 214, 230, 276, 278 provides a firearm assembly wherein various discrete operational functions associated with use of the firearm assembly can be operated in a number of manners.

Figure 10:
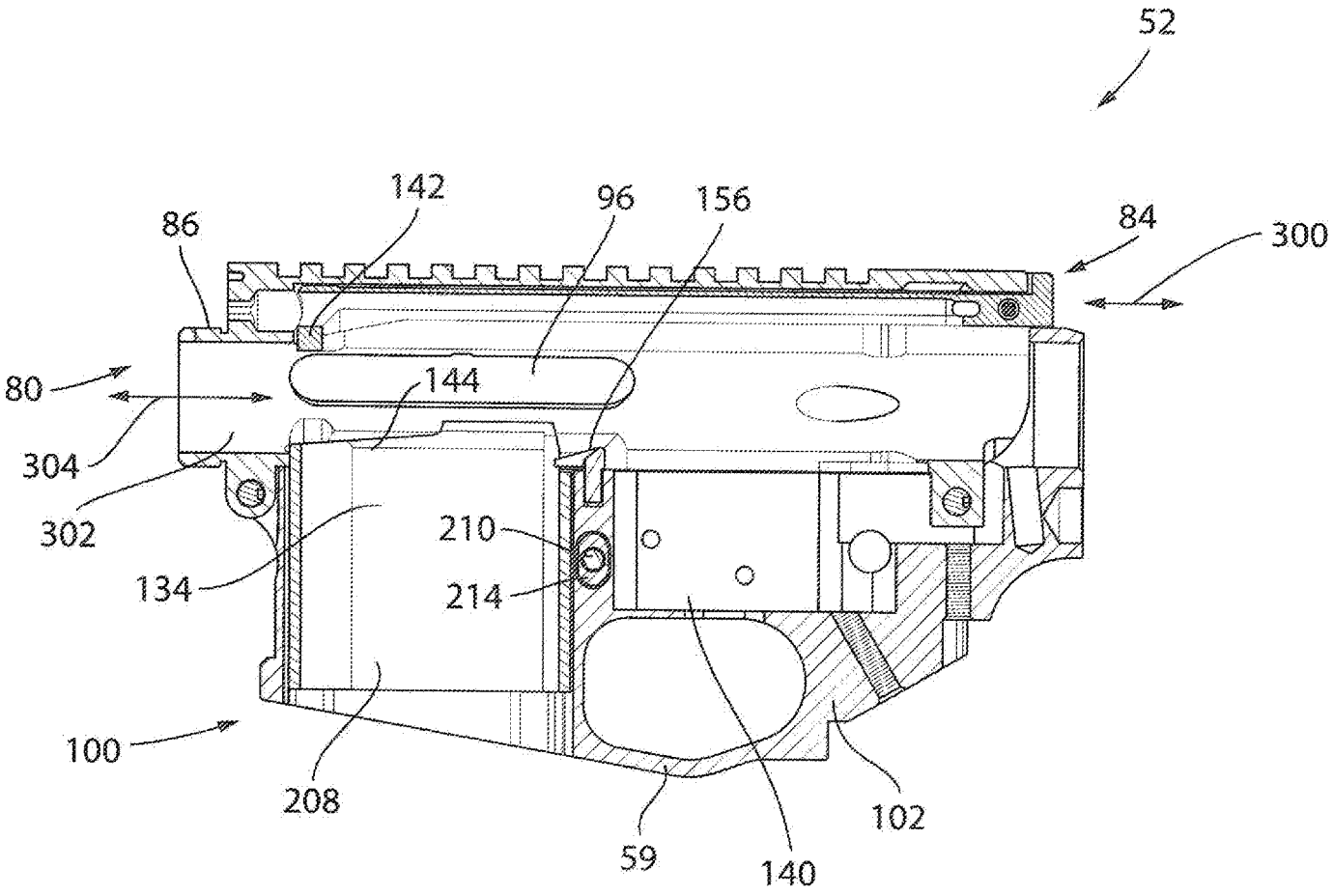
FIG. 10 is a longitudinal side elevation cross section view of the receiver assembly taken along line 10-10 shown in FIG. 2.
Figure 11:
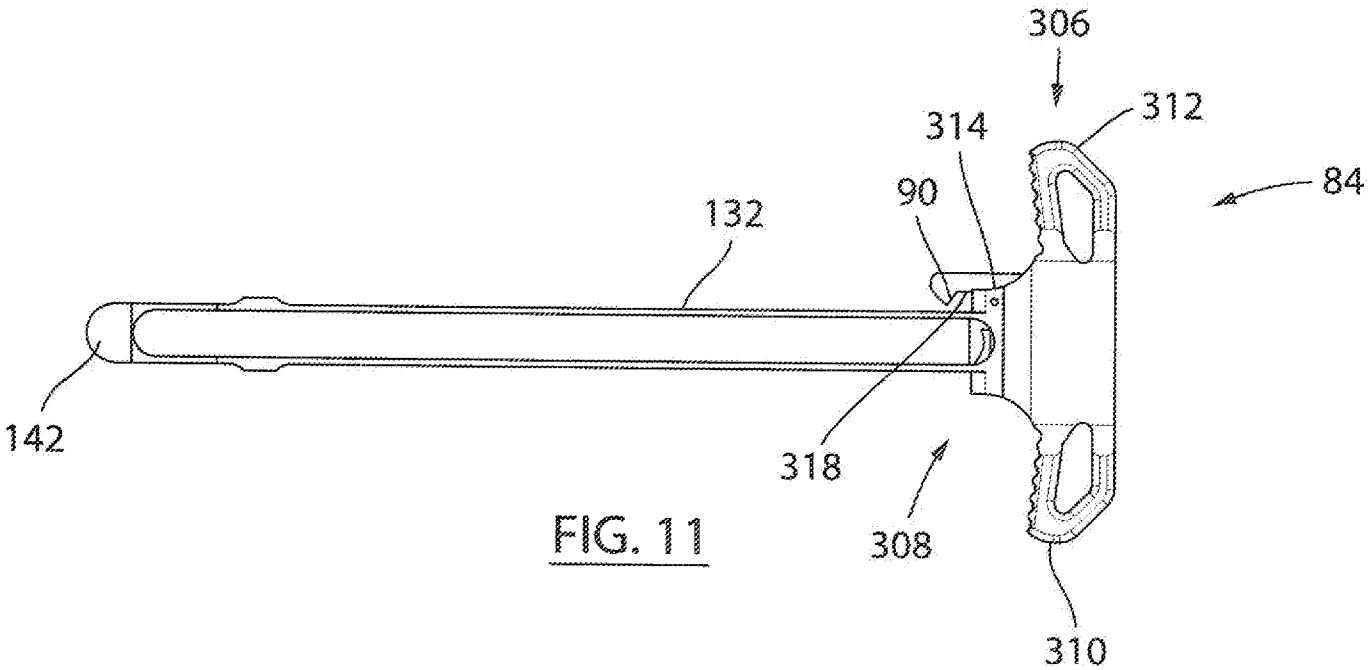
FIG. 11 is a bottom plan view of a charging handle assembly of the firearm assembly shown in FIG. 1.
Figure 12:
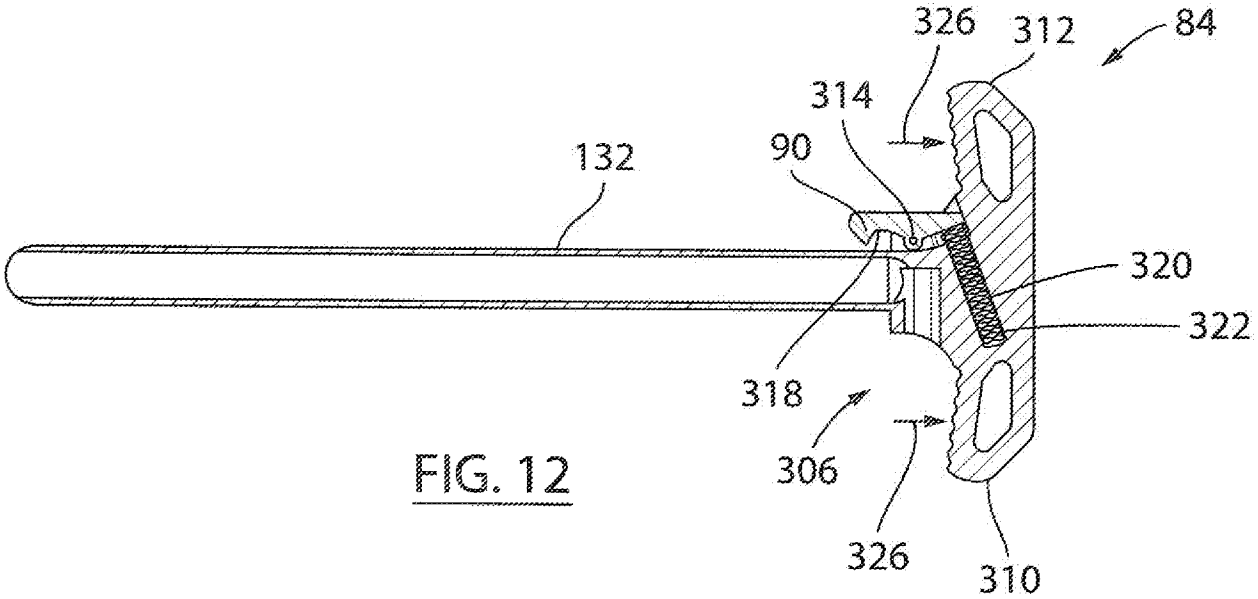
FIG. 12 is a cross section plan view of the charging handle assembly shown in FIG. 11.

As alluded to above and in reference to FIGS. 10-12, charging handle assembly 84 is also configured to be ambidextrously operable or operable in fairly intuitive manner with either the dominant hand or the non-dominant hand of the user. Charging handle assembly 84 is longitudinally displaceable relative to receiver assembly 52, as indicated by arrow 300, to effectuate rearward manual translation of a bolt 302 associated with operation of firearm assembly 40.

As is commonly understood, during automatic or repeat operation of firearm assembly 40, bolt 302 oscillates in a longitudinal direction, indicated by arrow 304, to effectuate the sequence of chambering a round, maintaining a closed condition of the firing chamber through discharge, ejecting a casing associated with the spent round, and chambering a subsequent round in a generally automatic action, i.e. with only user interaction with the trigger body 57 when the firearm is configured for discharge. It is periodically necessary, such as during reloading and/or clearing misfired cartridges, jams, etc, to manually manipulate or assist the forward and/or rearward translation of bolt 302 relative to the remainder of firearm assembly 40. Projection 142 of charging handle assembly 84 generally does not interfere with the longitudinal translation of bolt 302 during most firing conditions associated with operation of firearm assembly 40.

When manual rearward manipulation of bolt 302 is desired, user interaction with a handle portion 306 of charging handle assembly 84 can be initiated to affect the generally rearward translation of charging handle assembly 84, and bolt 302, until bolt 302 achieves the interfering engagement with both catch 156. As shown in FIGS. 11 and 12, and charging handle assembly 84 includes a handle portion 306 that is generally disposed at a respective rearward facing end 309 associated with stem 132 of the charging handle assembly 84. Handle portion 306 includes a first or right hand side handle or grip 310 and a left hand side handle or grip 312. Interaction with either or both of grips 310, 312 allows separation of projection or catch 90 from recess 88 of upper receiver 80 or upper receiver body or assembly.

Catch 90 is pivotably attached to handle portion 306 of charging handle assembly 84 so as to selectively interact with the recess 88 defined by upper receiver 80 when the charging handle assembly 84 is oriented in the closed or forward orientation relative thereto. An axis of rotation associated with catch 90 is defined by a pivot, such as a pin 314, that is positionally fixed relative to handle portion 306 of charging handle assembly 84. Catch 90 is defined by a body 308 is that rotationally cooperates with pivot 314. Referring to FIG. 12, handle portion 306 of charging handle assembly 84 includes a cavity 320 that is shaped to receive a biasing device, such as a spring 322, that interacts with body 318 associated with catch 90 so as to rotate catch 90 towards the closed position or position wherein the catch cooperates with recess 88 defined by upper receiver 80.

Spring 322, the orientation of pivot 314 relative to the interaction with spring 322 with body 318, and the orientation of catch 90 relative to pivot 314 are tuned such that a rearward force, indicated by arrows 326, imparted upon one or both of grips 310, 312 overcomes the bias associated with spring(s) 322 thereby allowing catch 90 to disengage from recess 88 associated with upper receiver 80 to effectuate the rearward longitudinal translation of charging handle assembly 84 relative to the underlying firearm assembly. In the configuration shown in FIGS. 11 and 12, grips 310, 312 define respective right hand and left hand operators associated with manual manipulation of charging handle assembly 84 relative to the underlying firearm assembly 40.

Figure 13:
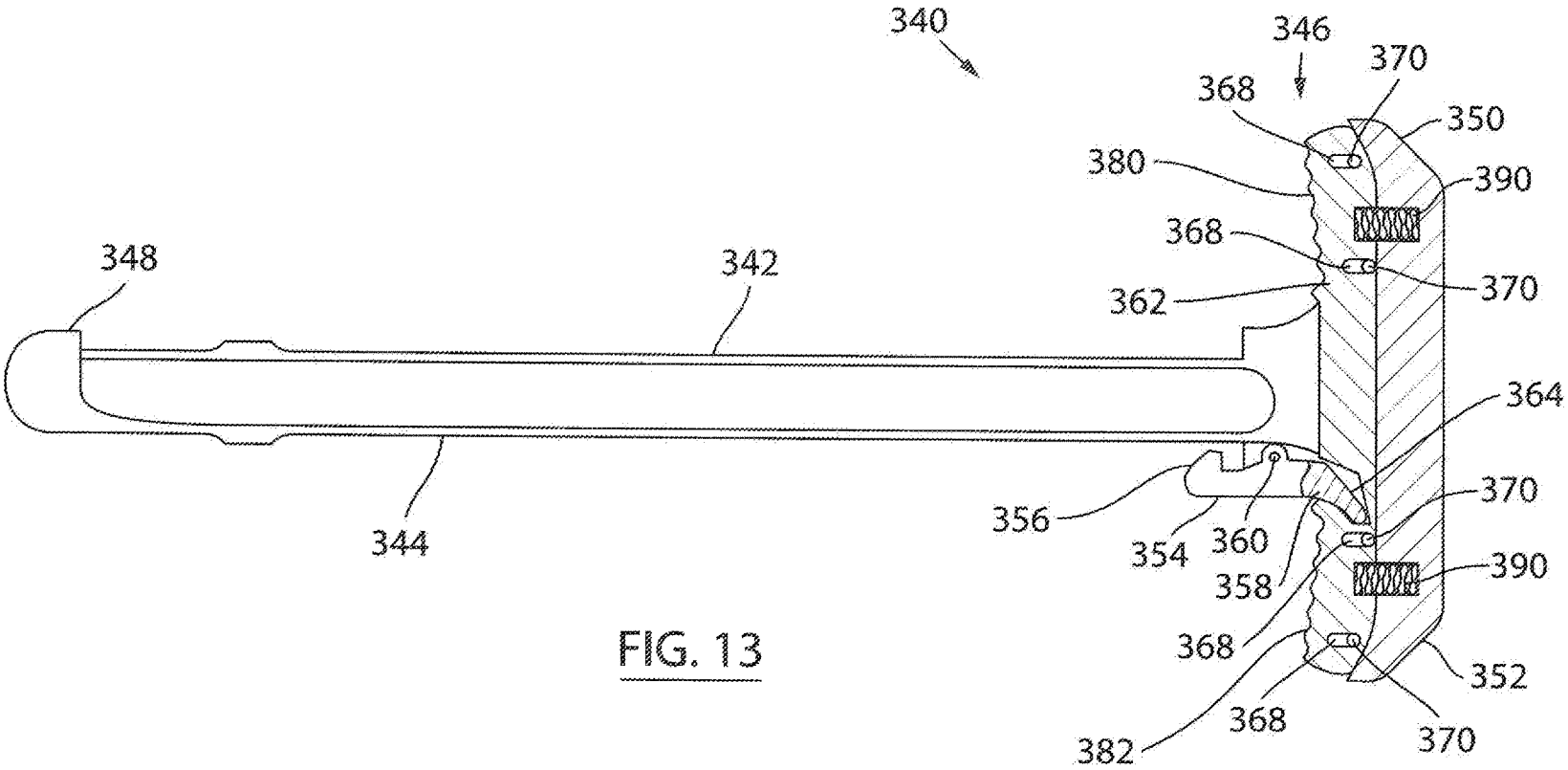
FIG. 13 is a view similar to FIG. 12 of another charging handle assembly usable with the firearm assembly shown in FIG. 1.

FIG. 13 is a view similar to FIG. 12 is of an alternate charging handle assembly 340 usable with firearm assembly 40. Charging handle assembly 40 includes an elongate body 342 generally defined by a shaft 344 that extends in a forward direction from a handle portion 346 of the charging handle assembly 340. A projection 348 is formed at a forward facing distal end of shaft 344 and is constructed to selectively interact with the bolt of the underlying firearm. Handle portion 346 includes a first or right hand grip 350 and a second or left hand grip 352. A catch 354 is pivotably connected to body 342 and selectively interacts with upper receiver 80 to secure charging handle assembly 340 in a generally forward orientation relative to a firearm assembly 40 and in a manner similar to the operation of charging handle assembly 84.

Catch 354 is defined by a projection 356 configured to selectively interact with recess 88 defined by upper receiver 80. A projection 358 extends in a generally rearward direction relative to projection 356 and a pivot 360 associated with securing catch 354 relative to handle portion 346 of charging handle assembly 340. An actuator or operator 362 slidably cooperates with handle portion 346 of charging handle assembly 340 and includes a cavity 364 that slidably cooperates with projection 358 associated with catch 354. Projection 358 and cavity 364 are shaped such that generally rearward translation of operator 362 relative to handle portion 346 effectuates rotation of catch 354 about pivot 360 so as to disengage projection 356 from recess 88 associated with upper receiver 80. Operator 362 includes one or more elongated grooves 368 that slidably cooperate with a respective projection 370 or pin that extends through the respective groove 368. Such a construction accommodates axial translation of operator 362, or translation of operator 362 in a direction generally aligned with a longitudinal direction associated with movable operation of charging handle assembly 340 relative to a firearm assembly 40.

Opposite ends of operator 362 extend beyond a forward facing edge of handle grips 350, 352 so as to define a right-hand actuation area 380 and a left-hand actuation area 382 that are each configured to be depressed by a user so as to affect the rearward axial translation of operator 362 and thereby the rotational operation of catch 354 relative to recess 88. A biasing device, such as one or more springs 390, bias operator 362 in a generally forward direction and thereby bias projection 356 toward a position of engagement with recess 88 of upper receiver 80. User interaction with either of actuation areas 380, 382 effectuates rotational movement of catch 354 and thereby the displacement of projection 356 from interference with recess 88 associated with upper receiver 80 and thereby the rearward manual translation of charging handle assembly 340 relative to the underlying firearm assembly 40.

It is appreciated that charging handle assemblies 84, 340 are exemplary of only two ambidextrously operable charging handle assembly configurations and constructions usable with firearm assembly 40 and that other charging handle assemblies are usable with firearm assembly 40. It is further appreciated that the ambidextrous operation of any charging handle assembly associated with firearm assembly 40 preferably supplements the ambidextrous operation of the bolt catch assembly, the magazine catch assembly, and the SAFE/FIRE selection switch associated with operation of firearm assembly 40.

Therefore, one embodiment of the present invention includes a firearm receiver assembly having a receiver body that includes a forward oriented portion that defines a magazine cavity that is shaped to slidably cooperate with a magazine. The receiver body includes a first side wall and a second side wall that are oriented on opposite lateral sides of the magazine cavity. A trigger guard is defined by the receiver body and extends in a downward direction rearward of the forward oriented portion of the receiver body. A bolt catch assembly extends in a lateral direction across the receiver body. The bolt catch assembly a first operator and a second operator that are operable from respective opposite lateral sides of the receiver body. The first operator includes a first portion that defines a bolt catch and a second portion that defines an actuator such that the actuator and the bolt catch are on opposite sides of the first side wall of the receiver body. A post extends from the first operator in a direction toward the second side wall of the receiver body. The second operator is associated with the second side wall of the receiver body and defines an opening that is circumferentially bounded by the second operator. The opening associated with the second operator slidably cooperates with the post defined by the first operator such that operation of either of the first operator or the second operator moves the bolt catch out of interference with a bolt of a firearm.

Another embodiment of the invention that is usable or combinable with one or more of the aspects of the above embodiment includes a firearm receiver assembly that includes a lower receiver body that defines a magazine cavity that is constructed to removably cooperate with a magazine. The receiver assembly supports a magazine catch assembly that is operable from opposite lateral sides of the lower receiver body to release a magazine from the lower receiver body. The magazine catch assembly includes a base having a tang that is disposed proximate one end of base. The tang is configured to selectively engage a magazine to secure a magazine relative to the magazine cavity when the tang is engaged with a magazine. The base is further defined as being laterally movable relative to the lower receiver body. A first magazine release operator extends from an opposite end of the base across the lower receiver body. The first magazine release is operable from outside the lower receiver body and slidable relative to the lower receiver body to selectively bias the tang out of engagement with a magazine. The assembly includes a second magazine release operator that is disposed on a common side of the lower receiver body as the base and pivotably connected to the lower receiver body such that rotation of the second magazine release operator selectively biases the tang out of engagement with a magazine.

A further embodiment of the invention that is usable or combinable with one or more of the above embodiments includes a method of forming an ambidextrously operable firearm receiver assembly. The method includes providing a lower receiver body. A magazine catch assembly is provided that includes a first magazine release operator and a second magazine release operator. The magazine catch assembly cooperates with the lower receiver body such that the magazine catch assembly is operable from opposite lateral sides of the lower receiver body to release a magazine from the lower receiver body. The first magazine release operator is slidable relative to the lower receiver body and the second magazine release operator is pivotable relative to the lower receiver body. A bolt catch assembly is provided that includes a first bolt release operator and a second bolt release operator. The bolt catch assembly cooperates with the lower receiver body such that the bolt catch assembly is operable from opposite lateral sides of the lower receiver body to release the bolt. The first bolt release operator is pivotable about a first pivot axis relative to the lower receiver body and the second bolt release operator is pivotable relative to the lower receiver body about a second pivot axis that is oriented in a crossing direction relative to the first pivot axis.

The present invention has been described in terms of the preferred embodiments. The several embodiments disclosed herein are related as being directed to the assembly as generally shown in the drawings. It is recognized that equivalents, alternatives, and modifications, aside from those expressly stated, the embodiments summarized, or the embodiment shown in the drawings, are possible and within the scope of the appending claims. It is further appreciated that aspects of the multiple embodiments are not specific to any of the particular embodiment and may be applicable between one or more of the disclosed embodiments. The appending claims cover all such alternatives and equivalents.

What is claimed is:

1. A firearm receiver assembly comprising:

a lower receiver body defining a magazine cavity constructed to removably cooperate with a magazine; and a magazine catch assembly that is operable from opposite lateral sides of the lower receiver body to release a magazine from the lower receiver body, the magazine catch assembly comprising:

a base having a tang disposed at one end, the tang being configured to selectively engage a magazine to secure a magazine relative to the magazine cavity when the tang is engaged with a magazine, the base being laterally movable relative to the lower receiver body;

a first magazine release operator extending from an opposite end of the base across the lower receiver body, the first magazine release being operable from outside the lower receiver body and slidable relative to the lower receiver body to selectively bias the tang out of engagement with a magazine; and a second magazine release operator disposed on a common side of the lower receiver body as the base and pivotably connected directly to the lower receiver body such that rotation of the second magazine release operator selectively biases the tang out of engagement with a magazine.

2. The firearm receiver assembly of claim 1 wherein the first magazine release further comprises a post that extends in a lateral direction across the lower receiver body.

3. The firearm receiver assembly of claim 2 wherein the second magazine release operator extends on opposite sides of the post of the first magazine release operator.

4. The firearm receiver assembly of claim 2 further comprising a button secured to an end of the post that is opposite the base.

5. The firearm receiver assembly of claim 4 wherein the lower receiver body further defines an opening that is shaped to slidably cooperate with the button.

6. The firearm receiver assembly of claim 1 wherein the second magazine release operator further comprises a tang that overlaps a laterally inward facing side of the base.

7. The firearm receiver assembly of claim 1 further comprising a bolt catch release assembly that includes a first bolt release operator that is operable from a first lateral side of the lower receiver body and a second bolt release operator that is operable from a second lateral side of the lower receiver body.

8. A method of forming an ambidextrously operable firearm assembly, the method comprising:

providing a lower receiver body;

providing a magazine catch assembly having a first magazine release operator and a second magazine release operator that cooperates with the lower receiver body such that the magazine catch assembly is operable from opposite lateral sides of the lower receiver body to release a magazine from the lower receiver body and the first magazine release operator is slidable relative to the lower receiver body and the second magazine release operator is connected directly to the lower receiver body via a pivot; and providing a bolt catch assembly having a first bolt release operator and a second bolt release operator that cooperates with the lower receiver body such that the bolt catch assembly is operable from opposite lateral sides of the lower receiver body to release the bolt.

9. The method of claim 8 further comprising connecting the first bolt release operator such that the first bolt release operator is pivotable about a first pivot axis relative to the lower receiver body and the second bolt release operator is pivotable relative to the lower receiver body about a second pivot axis that is oriented in a crossing direction relative to the first pivot axis.

10. The method of claim 8 further comprising providing an upper receiver body that removably cooperates with the lower receiver body.

11. The method of claim 8 further comprising providing a magazine that removably cooperates with a magazine cavity defined by the lower receiver body and selectively engages a tang that is selectively movable relative to the lower receiver body via operation of one of the first magazine release operator or the second magazine release operator.

12. The method of claim 8 further comprising operatively connecting the first bolt release operator to the second bolt release operator by a post and a circumferential pocket engagement.

13. The method of claim 8 further comprising providing a safety switch assembly that includes a first safety switch and a second safety switch that are operable from respective opposite lateral sides of the lower receiver body.

14. The method of claim 8 further comprising providing a firearm charging handle having a forward end configured to cooperate with a bolt of a firearm and a rearward end offset from the forward end along a longitudinal axis of the body, forming a handle section of the firearm charging handle to have a first grip portion and a second grip portion that extend in opposite lateral directions relative to the longitudinal axis of the body proximate the rearward end of the body, pivotably supporting a latch by the body proximate the handle section to selectively cooperate with a housing of the firearm, and supporting an actuator by the handle section such that the actuator is movable relative to the body in a direction aligned with the longitudinal axis of the body to manipulate interaction of the latch with the housing of the firearm.

15. A firearm receiver assembly comprising:

a lower receiver that defines a magazine cavity constructed to removably cooperate with a magazine; and a magazine catch assembly that is operable from opposite lateral sides of the lower receiver body to selectively release a magazine from the lower receiver body, the magazine catch assembly comprising:

a base having a tang that is configured to selectively engage a magazine to secure a magazine relative to the magazine cavity when the tang is engaged with a magazine, the base being laterally movable relative to the lower receiver body;

a first magazine release operator that is connected to the base and which extends across the lower receiver body such that the first magazine release operator is operable from outside the lower receiver body and slidable relative to the lower receiver body to selectively bias the tang out of engagement with a magazine; and a second magazine release operator disposed on a common side of the lower receiver body as the base and pivotably connected directly to the lower receiver such that motion of the first magazine release operator does not affect an orientation of the second magazine release operator relative to the lower receiver body during operation of the first magazine operator and such that rotation of the second magazine release operator relative to the receiver selectively biases the tang out of engagement with a magazine.

16. The firearm receiver assembly of claim 15 further comprising a bolt catch assembly that extends in a lateral direction across the lower receiver body, the bolt catch assembly further comprising a first operator that includes a first portion that defines a bolt catch and a second portion that defines an actuator and a second operator associated with the receiver body that slidably cooperates with a portion of the first operator such that operation of either of the first operator or the second operator moves the bolt catch out of interference with a bolt of a firearm.

17. The firearm receiver assembly of claim 16 wherein the bolt catch is biased into engagement with the bolt.

18. The firearm receiver assembly of claim 16 wherein an axis of rotation of the first operator is oriented at a crossing direction relative to an axis of rotation of the second operator.

19. The firearm receiver assembly of claim 18 wherein the axis of rotation of the first operator is aligned with a direction of operation of the bolt.

20. The firearm receiver assembly of claim 15 further comprising a firearm charging handle having a forward end configured to cooperate with a bolt of a firearm and a rearward end offset from the forward end along a longitudinal axis of a body of the firearm charging handle, the firearm charging handle including a handle section that includes a first grip portion and a second grip portion that extend in opposite lateral directions relative to a longitudinal axis of the body proximate the rearward end of the body, a latch that is supported by the body proximate the handle section to selectively cooperate with a housing of the firearm, and an actuator that is supported by the handle section such that the actuator is movable relative to the body in a direction aligned with the longitudinal axis of the body to manipulate interaction of the latch with the housing of the firearm via user interaction with either of the first grip portion or the second grip portion.

* * * * *